US009669651B2

(12) United States Patent
Zhong et al.

(10) Patent No.: US 9,669,651 B2
(45) Date of Patent: Jun. 6, 2017

(54) FULLY-AUTOMATIC PENCIL SHARPENER

(71) Applicant: GuangZhou PanYu Tung Yung Stationery MFY., LTD, Guangzhou (CN)

(72) Inventors: Liangchun Zhong, Guangzhou (CN); Zhongmin Duan, Guangzhou (CN); Changhai Dai, Guangzhou (CN)

(73) Assignee: GuangZhou PanYu Tung Yung Stationery MFY., LTD., Guangzhou (CN)

( * ) Notice: Subject to any disclaimer, the term of this patent is extended or adjusted under 35 U.S.C. 154(b) by 793 days.

(21) Appl. No.: 14/096,035

(22) Filed: Dec. 4, 2013

(65) Prior Publication Data

US 2015/0000791 A1 Jan. 1, 2015

(30) Foreign Application Priority Data

Jun. 28, 2013 (CN) ..... 2013 2 0382758 U

(51) Int. Cl.
*B43L 23/02* (2006.01)
*B43L 23/00* (2006.01)

(52) U.S. Cl.
CPC ..... *B43L 23/008* (2013.01); *B43L 23/02* (2013.01)

(58) Field of Classification Search
CPC ..... B43L 23/00; B43L 23/008; B43L 23/06; B43L 23/08; B43L 23/085
See application file for complete search history.

(56) References Cited

U.S. PATENT DOCUMENTS 4,966,208 A * 10/1990 Uang ..... B43L 23/02 144/248.6
7,240,703 B2 * 7/2007 Hu ..... B43L 23/002 144/28.5
7,726,365 B2 * 6/2010 Hu ..... B43L 23/002 144/28.7
7,913,731 B2 * 3/2011 Sued ..... B43L 23/00 144/28.72
8,016,004 B2 * 9/2011 Farooq ..... B43L 23/00 144/28.6
8,196,624 B2 * 6/2012 Farnworth ..... B43L 23/008 144/28.72
2011/0179654 A1 * 7/2011 Liu ..... B43L 23/008 30/454
2013/0255835 A1 * 10/2013 Wang ..... B43L 23/002 144/28.2

* cited by examiner

*Primary Examiner* — Matthew G Katcoff
(74) *Attorney, Agent, or Firm* — Kilpatrick Townsend & Stockton LLP

(57) ABSTRACT

A fully-automatic pencil sharpener is provided according to embodiments of the present application, which may avoid the problem of the pencil being overly sharpened in the conventional electric pencil sharpener, and realize a maximized utilization of the length of the pencil, thus is more economical and environmental friendly compared to the conventional electric pencil sharpener. The fully-automatic pencil sharpener according to embodiments of the present application includes a pencil-pushing module, a pencil-sharpening module, a power module, a detection module, a control module and a housing. The pencil-pushing module is adapted to push a pencil to a preset position, for example pushing the pencil to the pencil-sharpening module when the pencil is placed in the pencil sharpener, and pushing the pencil out of the fully-automatic pencil sharpener when the pencil has been sharpened.

9 Claims, 7 Drawing Sheets

FULLY-AUTOMATIC PENCIL SHARPENER

The present application claims the benefit of priority to Chinese patent application No. 201320382758.7 titled "FULLY-AUTOMATIC PENCIL SHARPENER", filed with the Chinese State Intellectual Property Office on Jun. 28, 2013. The entire disclosure thereof is incorporated herein by reference.

TECHNICAL FIELD

The present application relates to the technical field of pencil sharpeners, and in particular to a fully-automatic pencil sharpener.

BACKGROUND

Electric pencil sharpener is a common stationery and consists of a housing assembly, a tool holder assembly, a driving assembly, a power supply assembly, and etc. The tool holder assembly, the driving assembly and the power supply assembly are arranged in an internal space of the housing assembly. The driving assembly consists of a motor and a gear box, and etc., the motor is electrically connected to the power supply assembly, and the gear box is drivably connected to the motor and the tool holder assembly, thus, the power of the motor may be transmitted to the tool holder to drive a blade on the tool holder to rotate, thereby finishing the pencil-sharpening process completely.

When using the conventional electric pencil sharpener, a pencil has to be pushed in manually, and determination of whether the pencil is sharpened depends on subjective judgment of a user, therefore the pencil tends to be overly sharpened in the pencil-sharpening process, which may cause a great waste. Thus, a more economical and environmental friendly electric pencil sharpener is required to meet the requirements of users, due to the problem of resource exhaustion.

SUMMARY

A fully-automatic pencil sharpener is provided according to embodiments of the present application, wherein a pencil tip slider and a pencil-stopping micro switch are arranged in a pencil-sharpening module, so as to realize functions of detecting whether the pencil has been sharpened and stopping pushing the pencil automatically, thereby avoiding the problem of the pencil being overly sharpened in the conventional electric pencil sharpener, and realizing a maximized utilization of the length of the pencil. Thus, compared to the conventional electric pencil sharpener, the fully-automatic pencil sharpener according to the present application is more economical and environmental friendly.

The fully-automatic pencil sharpener according to embodiments of the present application includes:

- a pencil-pushing module adapted to push a pencil to a preset position, and pushing a pencil to a preset position includes pushing the pencil to a pencil-sharpening module when the pencil is placed in the pencil sharpener, and pushing the pencil out of the fully-automatic pencil sharpener when the pencil has been sharpened;
- the pencil-sharpening module adapted to sharpen the pencil;
- a power module adapted to provide power for the fully-automatic pencil sharpener;

- a detection module adapted to detect a position of the pencil and a sharpening status of the pencil, and send a detection result to a control module;
- the control module adapted to control the power module according to the detection result; and
- a housing adapted to support the fully-automatic pencil sharpener.

Optionally, the detection module includes a pencil-pushing micro switch, a pencil-stopping micro switch and a power micro switch;

- the pencil-pushing micro switch is arranged in the pencil-pushing module and is adapted to send a signal for pushing the pencil to the control module when detecting that the pencil is placed in the fully-automatic pencil sharpener;
- the pencil-stopping micro switch is arranged in the pencil-sharpening module, and is adapted to send a signal for stopping pushing the pencil to the control module when detecting that the pencil has been sharpened;
- the power micro switch is arranged in the pencil-pushing module, and is adapted to send a power signal to the control module when detecting that the fully-automatic pencil sharpener is fully closed; and
- the detection results include the signal for pushing the pencil, the signal for stopping pushing the pencil and the power signal.

Optionally, the power module includes a change gear set, a motor and a power supply;

- the change gear set is connected to the motor and is adapted to change a transmission angular velocity of the motor;
- the power supply is connected to the control module and is adapted to provide power; and
- the power supply is connected to the motor and is adapted to provide electric power for the motor.

Optionally, the power supply is an external power supply.

Optionally, the power supply is a battery.

Optionally, the pencil-pushing module includes a pencil-pushing slider and a pencil-pushing mechanism;

- the pencil-pushing slider is arranged on the housing and is adapted to trigger the pencil-pushing micro switch when the pencil is placed in the fully-automatic pencil sharpener; and
- the pencil-pushing mechanism includes a pencil-pushing gear set, a pencil-pushing frame, a rotating shaft assembly and a soft rubber wheel, wherein the pencil-pushing gear set is mounted on the pencil-pushing frame, the soft rubber wheel is mounted on the rotating shaft assembly, the rotating shaft assembly is connected to the pencil-pushing gear set, and the pencil-pushing gear set engages with the pencil-sharpening module.

Optionally, the pencil-sharpening module includes a tool holder, a transmission column, a pencil tip slider, a hob shaft, a hob and a hob gear set;

- the transmission column is adapted to connect the tool holder to the change gear set;
- the pencil tip slider is movably arranged on a slideway of the tool holder, and is connected to the pencil-stopping micro switch via a transmission shaft;
- the hob gear set is mounted on the tool holder and engages with the pencil-pushing gear set; and
- the hob shaft is mounted on the hob gear set, and the hob is mounted on the hob shaft.

Optionally, the control module includes a single-chip microcomputer, a first relay and a second relay;

- the single-chip microcomputer is adapted to control the motor according to the detection results;

the first relay is connected to the single-chip microcomputer and the motor, and is adapted to control the motor to rotate forwardly according to an instruction from the single-chip microcomputer; and the second relay is connected to the single-chip microcomputer and the motor, and is adapted to control the motor to rotate reversely according to an instruction from the single-chip microcomputer.

Optionally, the housing includes a transparent bin and a housing case;

the transparent bin is used cooperatively with the housing case and is adapted to contain garbage and to switch off the power micro switch when the transparent bin is mounted in the housing case; and the housing case has an inclined surface at a position below the pencil-sharpening module and above the transparent bin.

Optionally, the fully-automatic pencil sharpener further includes a push-pull switch and a push-pull switch rod;

the push-pull switch is adapted to control the motor to rotate reversely; and the push-pull switch rod is adapted to control an on-off state of the push-pull switch.

The fully-automatic pencil sharpener according to embodiments of the present application includes the pencil-pushing module, the pencil-sharpening module, the power module, the detection module, the control module and the housing. The pencil-pushing module is adapted to push a pencil to a preset position, for example pushing the pencil to the pencil-sharpening module when the pencil is placed in the pencil sharpener, and pushing the pencil out of the fully-automatic pencil sharpener when the pencil has been sharpened. The pencil-sharpening module is adapted to sharpen the pencil. The power module is adapted to provide power for the fully-automatic pencil sharpener. The detection module is adapted to detect a position of the pencil and a sharpening status of the pencil, and send a detection result to the control module. The control module is adapted to control the power module according to the detection result. The housing is adapted to support the fully-automatic pencil sharpener The pencil tip slider and the pencil-stopping micro switch are arranged in the pencil-sharpening module, so as to realize functions of detecting whether the pencil has been sharpened and stopping pushing the pencil automatically, thereby avoiding the problem of the pencil being overly sharpened in the conventional electric pencil sharpener, and realizing a maximized utilization of the length of the pencil. Thus, compared to the conventional electric pencil sharpener, the fully-automatic pencil sharpener according to the present application is more economical and environmental friendly.

BRIEF DESCRIPTION OF THE DRAWINGS

For more clearly illustrating embodiments of the present application or the technical solution in the prior art, drawings referred to describe the embodiments or the prior art will be briefly described hereinafter. Apparently, the drawings in the following description are only several embodiments of the present application, and for the person skilled in the art other drawings may be obtained based on these drawings without any creative efforts.

DETAILED DESCRIPTION

A fully-automatic pencil sharpener is provided according to embodiments of the present application, wherein a pencil tip slider and a pencil-stopping micro switch are arranged in a pencil-sharpening module, so as to realize functions of detecting whether the pencil has been sharpened and stopping pushing the pencil automatically, thereby avoiding the problem of the pencil being overly sharpened in the conventional electric pencil sharpener, and realizing a maximized utilization of the length of the pencil. Thus, compared to the conventional electric pencil sharpener, the fully-automatic pencil sharpener according to the present application is more economical and environmental friendly.

Figure 1:
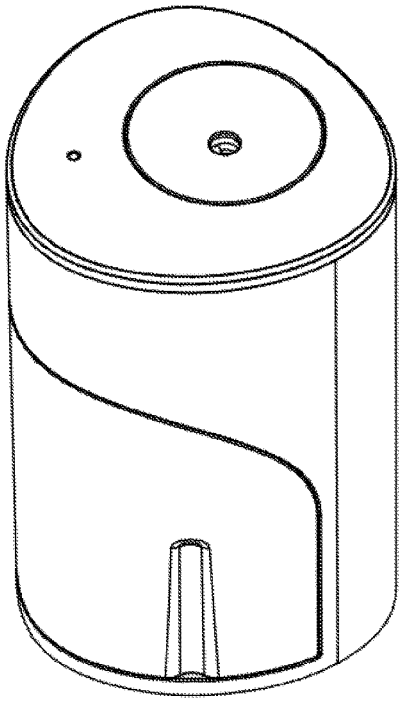
FIG. 1 is a perspective view of a fully-automatic pencil sharpener according to an embodiment of the present application.
Figure 2:
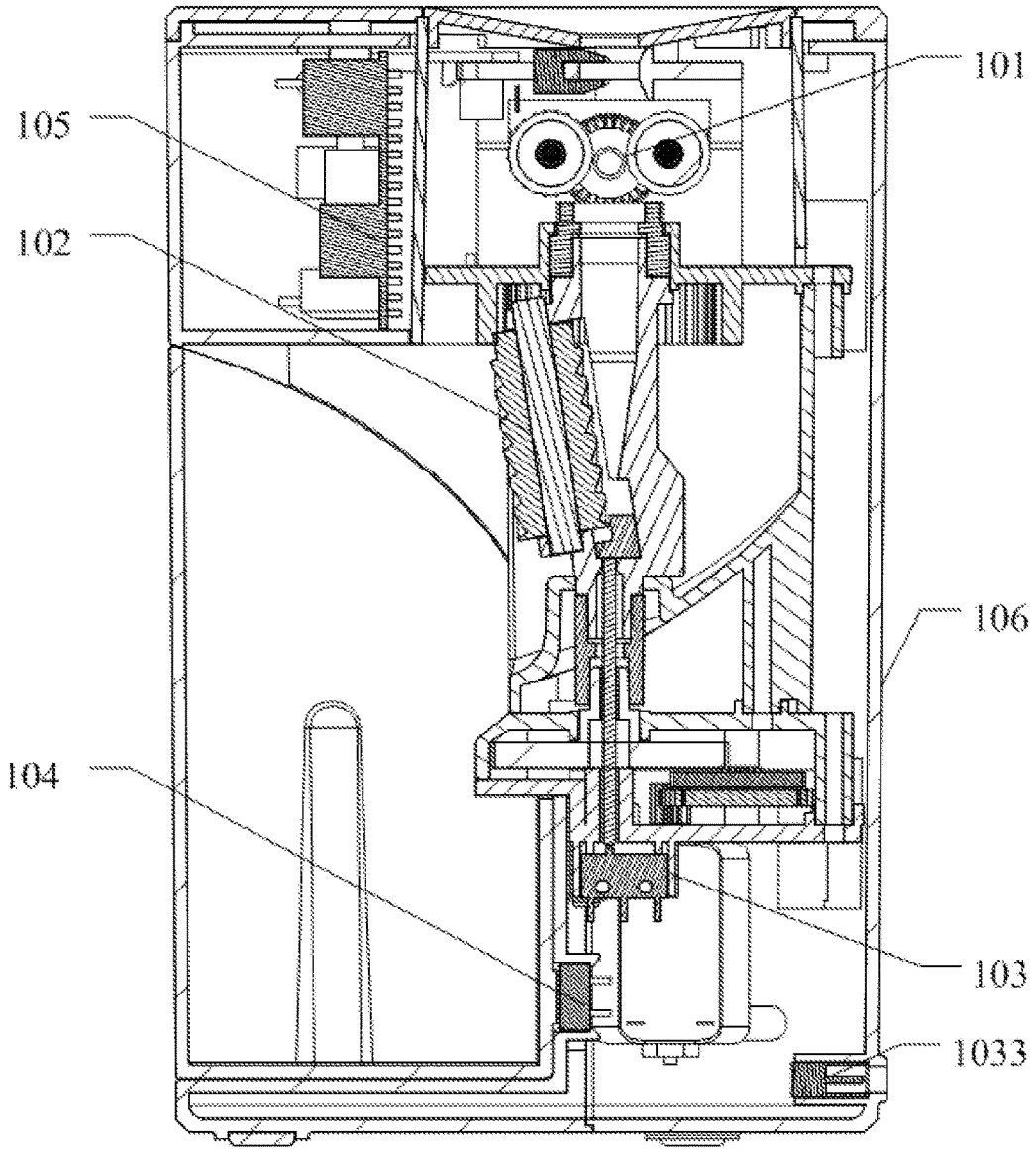
FIG. 2 is a sectional view of the fully-automatic pencil sharpener according to the embodiment of the present application.
Figure 3:
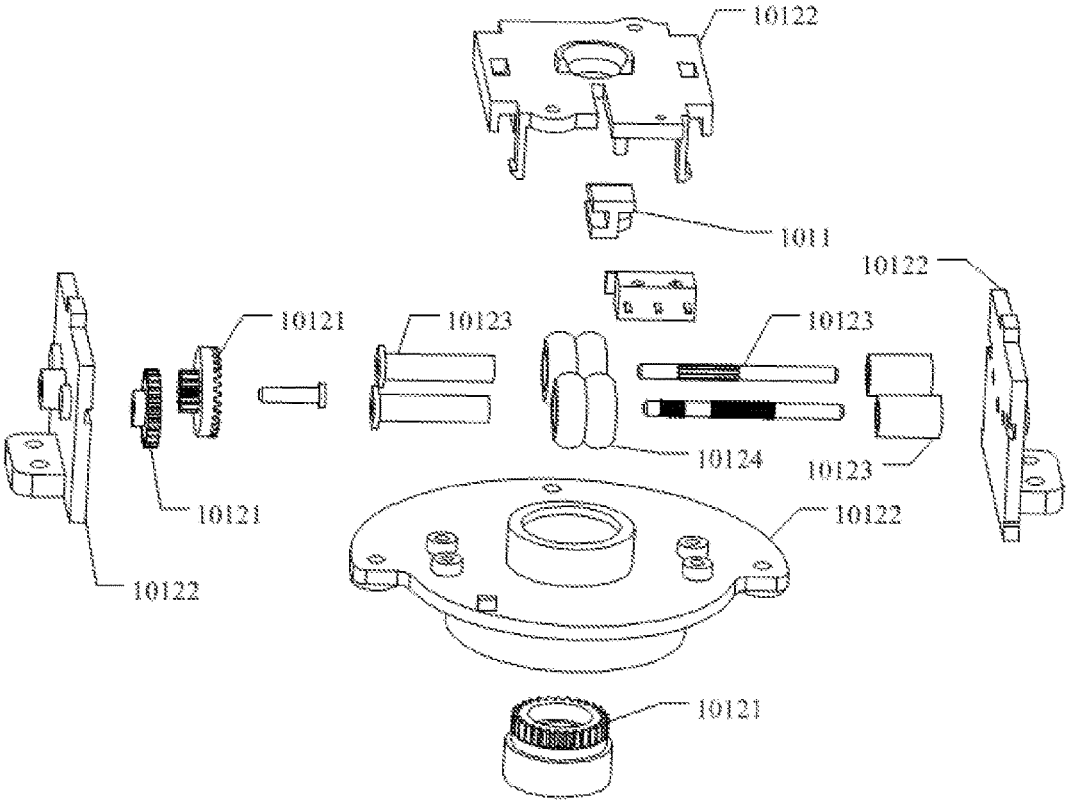
FIG. 3 is a schematic view showing the structure of a pencil-pushing module of the fully-automatic pencil according to the embodiment of the present application.
Figure 4:
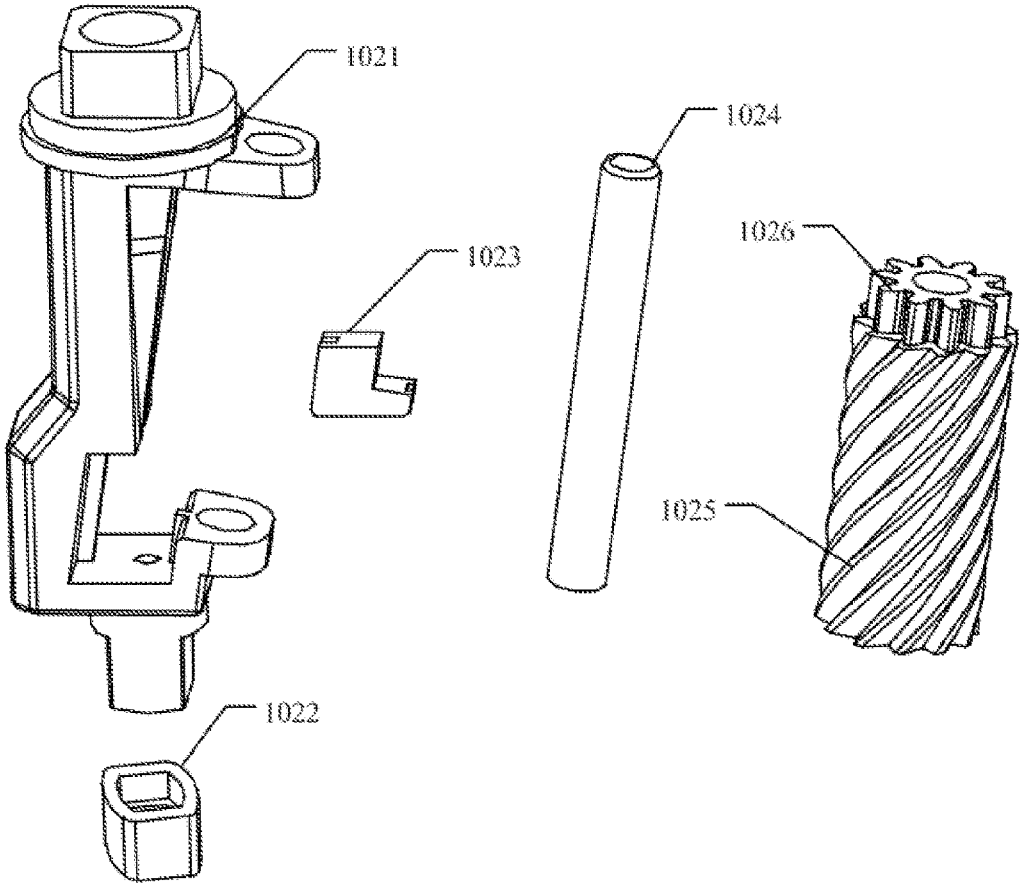
FIG. 4 is a schematic view showing the structure of a pencil-sharpening module of the fully-automatic pencil according to the embodiment of the present application.
Figure 5:
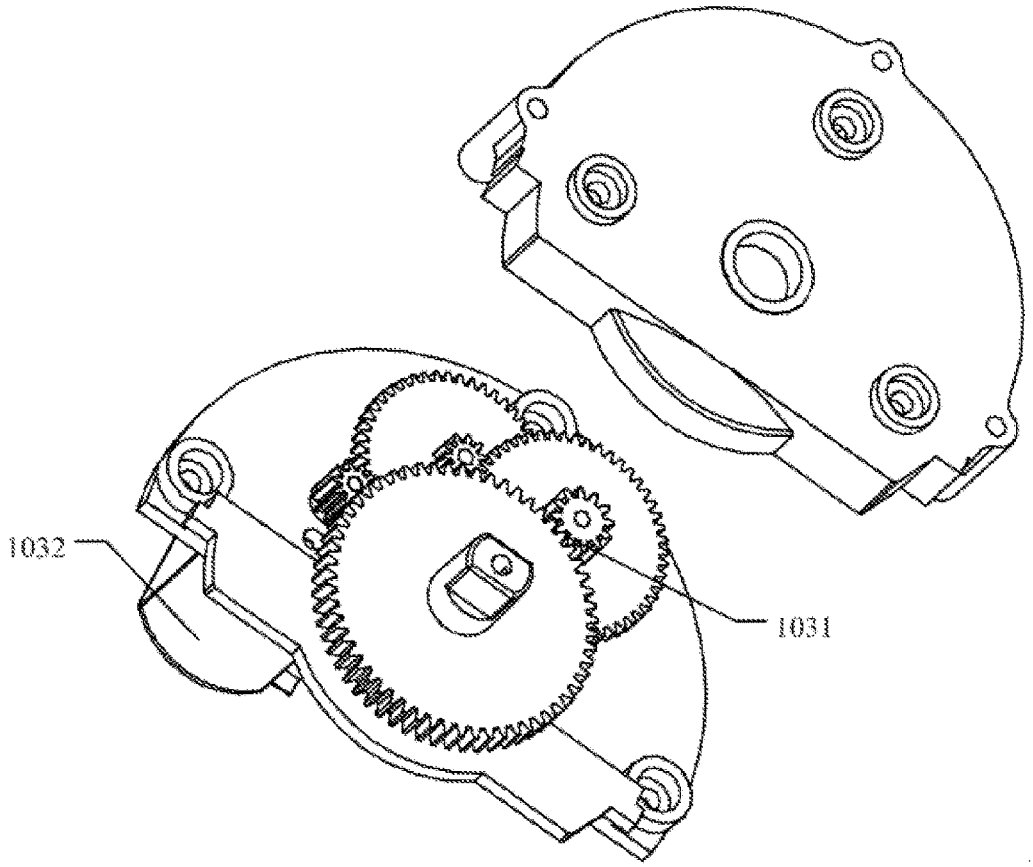
FIG. 5 is a schematic view showing the structure of a power module of the fully-automatic pencil according to the embodiment of the present application.
Figure 6:
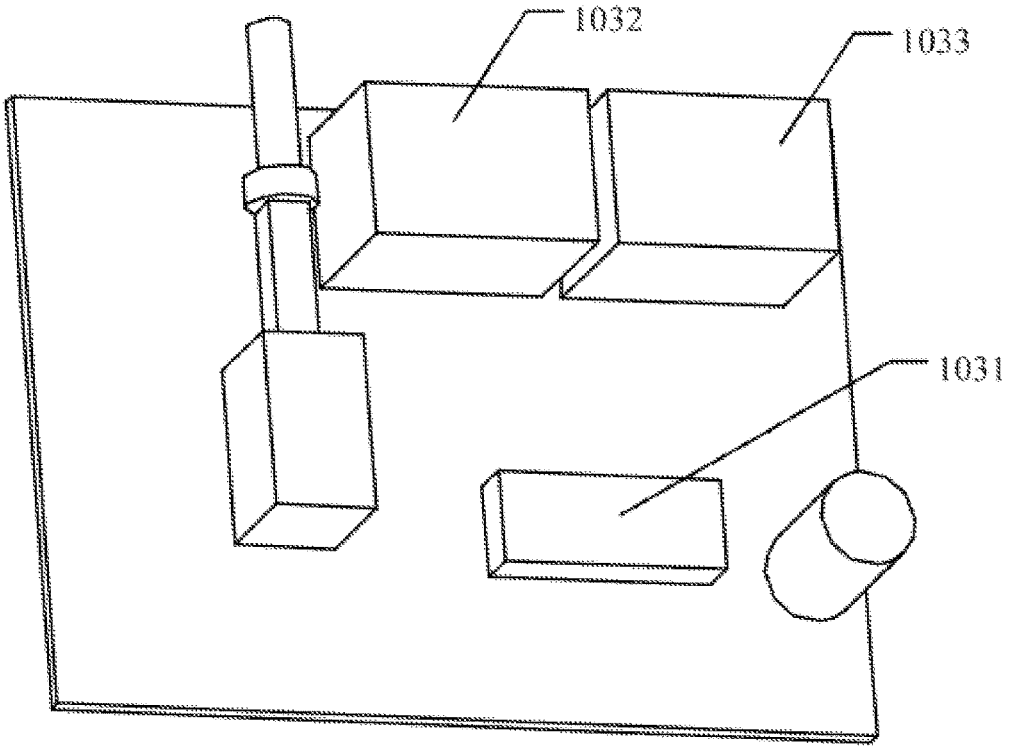
FIG. 6 is a schematic view showing the structure of a control module of the fully-automatic pencil according to the embodiment of the present application.
Figure 7:
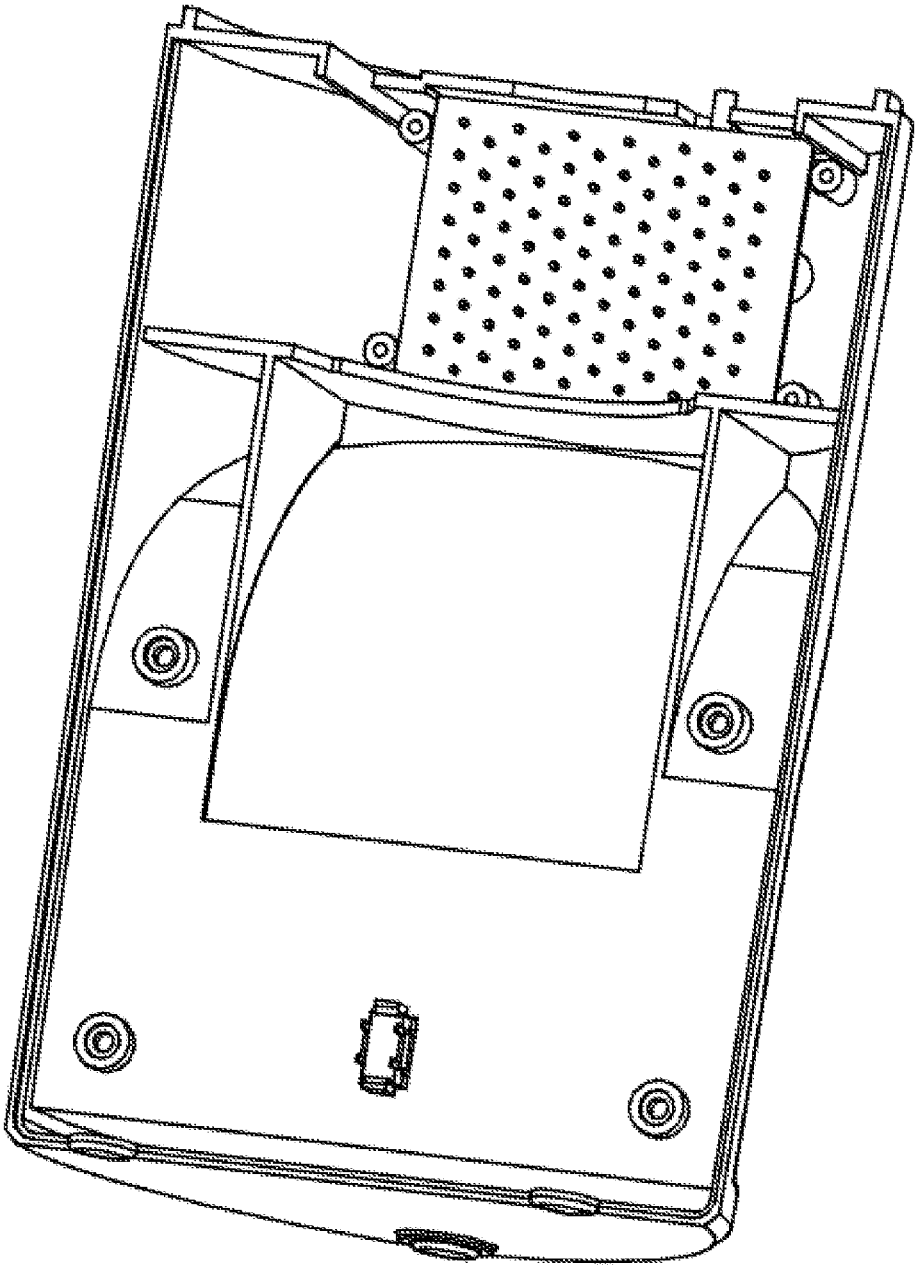
FIG. 7 is a schematic view showing the structure of a housing of the fully-automatic pencil according to the embodiment of the present application.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the protection scope of the present application. Referring to FIG. 1, the fully-automatic pencil sharpener according to an embodiment of the present application includes a pencil-pushing module 101, a pencil-sharpening module 102, a power module 103, a detection module 104, a control module 105 and a housing 106.

The pencil-pushing module 101 is adapted to push a pencil to a preset position, for example pushing the pencil to the pencil-sharpening module 102 when the pencil is placed in the pencil sharpener, and pushing the pencil out of the fully-automatic pencil sharpener when the pencil has been sharpened.

The pencil-sharpening module 102 is adapted to sharpen the pencil.

The power module 103 is adapted to provide power for the fully-automatic pencil sharpener.

The detection module 104 is adapted to detect a position of the pencil and a sharpening status of the pencil, and send a detection result to the control module 105.

The control module 105 is adapted to control the power module 103 according to the detection result.

The housing 106 is adapted to support the fully-automatic pencil sharpener.

The fully-automatic pencil sharpener according to the embodiment of the present application includes the pencil-pushing module 101, the pencil-sharpening module 102, the power module 103, the detection module 104, the control module 105 and the housing 106. When the detection module 104 detects that a pencil is placed in the automatic pencil sharpener, the control module 105 starts the power module 103, the pencil-pushing module 101 pushes the pencil into the pencil-sharpening module 102, and the pencil-sharpening module 102 sharpens the pencil. When the detection module 104 detects that the pencil has been sharpened, the pencil-pushing module 101 pushes the sharpened pencil out of the fully-automatic pencil sharpener, thereby finishing the sharpening process.

Optionally, the detection module 104 includes a pencil-pushing micro switch, a pencil-stopping micro switch and a power micro switch.

The pencil-pushing micro switch is arranged in the pencil-pushing module 101 and is adapted to send a signal for pushing the pencil to the control module 105 when detecting that the pencil is placed in the fully-automatic pencil sharpener.

The pencil-stopping micro switch is arranged in the pencil-sharpening module 102, and is adapted to send a signal for stopping pushing the pencil to the control module 105 when detecting that the pencil has been sharpened.

The power micro switch is arranged in the pencil-pushing module 101, and is adapted to send a power signal to the control module 105 when detecting that the fully-automatic pencil sharpener is fully closed.

The detection results include the signal for pushing the pencil, the signal for stopping pushing the pencil and the power signal.

Optionally, the power module 103 includes a change gear set 1031, a motor 1032 and a power supply 1033.

The change gear set 1031 is connected to the motor 1032 and s adapted to change a transmission angular velocity of the motor 1032.

The power supply 1033 is connected to the control module 105 and is adapted to provide power.

The power supply 1033 is connected to the motor 1032 and is adapted to provide electric power for the motor 1032.

Optionally, the power supply 1033 is an external power supply.

Optionally, the power supply 1033 is a battery.

Optionally, the pencil-pushing module 101 includes a pencil-pushing slider 1011 and a pencil-pushing mechanism 1012.

The pencil-pushing slider 1011 is arranged on the housing and is adapted to trigger the pencil-pushing micro switch when the pencil is placed in the fully-automatic pencil sharpener.

The pencil-pushing mechanist 1012 includes a pencil-pushing gear set 10121, a pencil-pushing frame 10122, a rotating shaft assembly 10123 and a soft rubber wheel 10124. The pencil-pushing gear set 10121 is mounted on the pencil-pushing frame 10122, the soft rubber wheel 10124 is mounted on the rotating shaft assembly 10123, the rotating shaft assembly 10123 is connected to the pencil-pushing gear set 10121, and the pencil-pushing gear set 10121 engages with the pencil-sharpening module 102.

Optionally, the pencil-sharpening module 102 includes a tool holder 1021, a transmission column 1022, a pencil tip slider 1023, a hob shaft 1024, a hob 1025 and a hob gear set 1026.

The transmission column 1022 is adapted to connect the tool holder 1021 to the change gear set 1031.

The pencil tip slider 1023 is movably arranged on a slideway of the tool holder 1021, and is connected to the pencil-stopping micro switch via a transmission shaft.

The hob gear set 1026 is mounted on the tool holder 1021 and engages with the pencil-pushing gear set 10121.

The hob shaft 1024 is mounted on the hob gear set 1026, and the hob 1025 is mounted on the hob shaft 1024.

Optionally, the control module 105 includes a single-chip microcomputer 1051, a first relay 1052 and a second relay 1053.

The single-chip microcomputer 1051 is adapted to control the motor 1032 according to the detection results.

The first relay 1052 is connected to the single-chip microcomputer 1051 and the motor 1032, and is adapted to control the motor 1032 to rotate forwardly according to an instruction from the single-chip microcomputer.

The second relay 1053 is connected to the single-chip microcomputer 1051 and the motor 1032, and is adapted to control the motor 1032 to rotate reversely according to an instruction from the single-chip microcomputer.

Optionally, the housing 106 includes a transparent bin and a housing case.

The transparent bin is used cooperatively with the housing case and is adapted to contain garbage and to switch on the power micro switch when the transparent bin is mounted in the housing case.

The housing case has an inclined surface at a position below the pencil-sharpening module 102 and above the transparent bin.

Optionally, the fully-automatic pencil sharpener further includes a push-pull switch and a push-pull switch rod.

The push-pull switch is adapted to control the motor 1032 to rotate reversely.

The push-pull switch rod is adapted to control an on-off state of the push-pull switch.

According to the embodiments of the present application, the transparent bin is mounted in the housing case to switch on the power micro switch, and the pencil-pushing slider 1011 switches on the pencil-pushing micro switch when the pencil is placed in the fully-automatic pencil sharpener, and at this time, the detection module 104 sends detection results, that the power micro switch and the pencil-pushing micro switch have been switched on, to the control module 105. The control module 105 controls the pencil-pushing module 101 to push the pencil to the pencil-sharpening module 102 to be sharpened, and the above control process is described as follows, the single-chip microcomputer 1051 controls the first relay 1032 to work according to the detection results, then the motor 1032 rotates forwardly to rotate the transmission column 1022 via the change gear set 1031, then the transmission column 1022 drives the tool holder 1021 to rotate. Since the hob gear set 1026 engages with the pencil-pushing gear set 10121, the tool holder 1021 drives the pencil-pushing module 101, and the soft rubber wheel 10124 of the pencil-pushing module 101 rotates to move the pencil downwards, and at the same time, the hob 1025 on the tool holder 1021 revolves to sharpen the pencil.

In the pencil sharpening process, a tip of the pencil pushes the pencil tip 1023 to slide along the slideway on the tool holder 1021, and when the pencil has been sharpened, the pencil tip slider 1023 switches on the pencil-stopping micro switch via the transmission shaft, then the detection module 104 sends a detection result that, the pencil-stopping micro switch has been switched on, to the control module 105, and the control module 105 controls the pencil-pushing module 101 to push the sharpened pencil out of the fully-automatic pencil sharpener, thereby finishing the sharpening process. The process of the control module 105 controlling the pencil-pushing module 101 to push the sharpened pencil out of the fully-automatic pencil sharpener is described as follows. The single-chip microcomputer 1051 controls the second relay 1053 to work according to the detection result, and the motor 1032 rotates reversely, the tool holder assembly and the soft rubber wheel 10124 also rotate reversely to move the pencil upwards, and the pencil-pushing micro switch restores the pencil tip slider to the initial state when the pencil tip moves to the pencil entrance.

The fully-automatic pencil sharpener according to embodiments of the present application includes the pencil-pushing module 101, the pencil-sharpening module 102, the power module 103, the detection module 104 the control module 105 and the housing 106. The pencil-pushing module 101 is adapted to push a pencil to a preset position, for example pushing the pencil to the pencil-sharpening module 102 when the pencil is placed in the pencil sharpener, and pushing the pencil out of the fully-automatic pencil sharpener when the pencil has been sharpened. The pencil-sharpening module 102 is adapted to sharpen the pencil. The power module 103 is adapted to provide power for the fully-automatic pencil sharpener. The detection module 104 is adapted to detect a position of the pencil and a sharpening status of the pencil, and send a detection result to the control module 105. The control module 105 is adapted to control the power module 103 according to the detection result. The housing 106 is adapted to support the fully-automatic pencil sharpener The pencil tip slider 1023 and the pencil-stopping micro switch are arranged in the pencil-sharpening module, so as to realize functions of detecting whether the pencil has been sharpened and stopping pushing the pencil automatically, thereby avoiding the problem of the pencil being overly sharpened in the conventional electric pencil sharpener, and realizing a maximized utilization of the length of the pencil. Thus, compared to the conventional electric pencil sharpener, the fully-automatic pencil sharpener according to the present application is more economical and environmental friendly.

The fully-automatic pencil sharpener according to the present application is described in detail hereinbefore. For those skilled in the art, modifications may be made to specific embodiments and application scopes based on the spirit of the present application. In conclusion, the content of the specification should not be interpreted as limitation to the present application.

What is claimed is:

1. A fully-automatic pencil sharpener, comprising:

a pencil-pushing module adapted to push a pencil to a preset position, and pushing a pencil to a preset position comprises pushing the pencil to a pencil-sharpening module when the pencil is placed in the pencil sharpener, and pushing the pencil out of the fully-automatic pencil sharpener when the pencil has been sharpened;

the pencil-sharpening module adapted to sharpen the pencil;

a power module adapted to provide power for the fully-automatic pencil sharpener;

a detection module adapted to detect a position of the pencil and a sharpening status of the pencil, and send a detection result to a control module;

the control module adapted to control the power module according to the detection result; and a housing adapted to support the fully-automatic pencil sharpener; and wherein the control module comprises a single-chip microcomputer, a first relay and a second relay;

the single-chip microcomputer is adapted to control a motor according to detection results;

the first relay is connected to the single-chip microcomputer and the motor, and is adapted to control the motor to rotate forwardly according to an instruction from the single-chip microcomputer; and the second relay is connected to the single-chip microcomputer and the motor, and is adapted to control the motor to rotate reversely according to an instruction from the single-chip microcomputer.

2. The fully-automatic pencil sharpener according to claim 1, wherein, the detection module comprises a pencil-pushing micro switch, a pencil-stopping micro switch and a power micro switch;

the pencil-pushing micro switch is arranged in the pencil-pushing module and is adapted to send a signal for pushing the pencil to the control module when detecting that the pencil is placed in the fully-automatic pencil sharpener;

the pencil-stopping micro switch is arranged in the pencil-sharpening module, and is adapted to send a signal for stopping pushing the pencil to the control module when detecting that the pencil has been sharpened;

the power micro switch is arranged in the pencil-pushing module, and is adapted to send a power signal to the control module when detecting that the fully-automatic pencil sharpener is fully closed; and the detection results comprise the signal for pushing the pencil, the signal for stopping pushing the pencil and the power signal.

3. The fully-automatic pencil sharpener according to claim 2, wherein, the power module comprises a change gear set, a motor and a power supply;

the change gear set is connected to the motor and is adapted to change a transmission angular velocity of the motor;

the power supply is connected to the control module and is adapted to provide power; and the power supply is connected to the motor and is adapted to provide electric power for the motor.

4. The fully-automatic pencil sharpener according to claim 3, wherein the power supply is an external power supply.

5. The fully-automatic pencil sharpener according to claim 3, wherein the power supply is a battery.

6. The fully-automatic pencil sharpener according to claim 3, wherein, the pencil-pushing module comprises a pencil-pushing slider and a pencil-pushing mechanism;

the pencil-pushing slider is arranged on a housing and is adapted to trigger the pencil-pushing micro switch when the pencil is placed in the fully-automatic pencil sharpener; and the pencil-pushing mechanism comprises a pencil-pushing gear set, a pencil-pushing frame, a rotating shaft assembly and a soft rubber wheel, wherein the pencil-pushing gear set is mounted on the pencil-pushing frame, the soft rubber wheel is mounted on the rotating shaft assembly, the rotating shaft assembly is connected to the pencil-pushing gear set, and the pencil-pushing gear set engages with the pencil-sharpening module.

7. The fully-automatic pencil sharpener according to claim 6, wherein, the pencil-sharpening module comprises a tool holder, a transmission column, a pencil tip slider, a hob shaft, a hob and a hob gear set;

the transmission column is adapted to connect the tool holder to the change gear set;

the pencil tip slider is movably arranged on a slideway of the tool holder, and is connected to the pencil-stopping micro switch via a transmission shaft;

the hob gear set is mounted on the tool holder and engages with the pencil-pushing gear set; and the hob shaft is mounted on the hob gear set, and the hob is mounted on the hob shaft.

8. The fully-automatic pencil sharpener according to claim 3, wherein, a housing comprises a transparent bin and a housing case;

the transparent bin is used cooperatively with the housing case and is adapted to contain garbage and to switch off the power micro switch when the transparent bin is mounted in the housing case; and the housing case has an inclined surface at a position below the pencil-sharpening module and above the transparent bin.

9. The fully-automatic pencil sharpener according to claim 3, wherein, the fully-automatic pencil sharpener further comprises a push-pull switch and a push-pull switch rod;

the push-pull switch is adapted to control the motor to rotate reversely; and the push-pull switch rod is adapted to control an on-off state of the push-pull switch.

* * * * *